US006749023B2

(12) United States Patent
Nguyen et al.

(10) Patent No.: US 6,749,023 B2
(45) Date of Patent: Jun. 15, 2004

(54) METHODS AND APPARATUS FOR GRAVEL PACKING, FRACTURING OR FRAC PACKING WELLS

(75) Inventors: Philip D. Nguyen, Duncan, OK (US); Michael W. Sanders, Duncan, OK (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/041,289

(22) Filed: Jan. 7, 2002

(65) Prior Publication Data

US 2002/0189809 A1 Dec. 19, 2002

Related U.S. Application Data

(63) Continuation-in-part of application No. 09/882,572, filed on Jun. 13, 2001.

(51) Int. Cl.[7] ..... E21B 43/08
(52) U.S. Cl. ..... 166/278; 166/51; 166/236
(58) Field of Search ..... 166/51, 228, 230, 166/236, 22.3, 227, 233

(56) References Cited

U.S. PATENT DOCUMENTS 6,464,007 B1 10/2002 Jones

*Primary Examiner*—William Neuder
(74) *Attorney, Agent, or Firm*—Peter V. Schroeder

(57) ABSTRACT

Improved methods and apparatus for completing a subterranean zone penetrated by a wellbore are provided. The improved methods include the steps of placing in the wellbore a perforated shroud (liner) having an internal sand screen therein (e.g., screens, screened pipes, perforated liners, prepacked screens, etc.), positioning about the perforated liner an alternate flowpath comprised of a plurality of "bypass" tubes or conduits having inlet passages or portions adapted to receive the gravel slurry as it reaches the apparatus and outlets for the slurry to reach the well annulus, and injecting particulate material (e.g., slurry) into the wellbore/perforated shroud and shroud/screen annuli, whereby the particulate material is uniformly packed into the two annuli and the zone. In one aspect of the invention, the multiple flow paths are provided via a series of blank tubes (e.g., without intermediate openings) with each tube extending only a portion of the length of each screen joint of the improved well tool. In another aspect of the invention, a plurality of axially-spaced "bundles" or series of radially-spaced, axially-extending bypass tubes are provided along the perforated shroud. A connector (or "mixer") is positioned between adjacent tube series which fluidly connects the tubes in the two adjacent series. The sand control screen inside the perforated shroud can be an expandable-screen type screen. The expandable screen can be expanded all the way out to the inside wall (ID) of the perforated shroud, allowing the screen to obtain maximum size if desired.

41 Claims, 11 Drawing Sheets

METHODS AND APPARATUS FOR GRAVEL PACKING, FRACTURING OR FRAC PACKING WELLS

CROSS-REFERENCE TO RELATED APPLICATIONS

This application is a continuation-in-part of application Ser. No. 09/882,572 filed Jun. 13, 2001 which is incorporated herein by reference.

STATEMENT REGARDING FEDERALLY SPONSORED RESEARCH OR DEVELOPMENT

Not applicable

REFERENCE TO MICROFICHE APPENDIX

Not applicable

TECHNICAL FIELD

This invention relates to improved methods and apparatus for completing wells, and more particularly, to improved methods and apparatus for gravel packing, fracturing or frac packing by providing multiple flow paths for slurry flow via bypass tubes or conduits in the well annulus.

BACKGROUND OF THE INVENTION

The production of hydrocarbons from unconsolidated or poorly consolidated formations may result in the production of sand along with the hydrocarbons. The presence of formation fines and sand is disadvantageous and undesirable in that the particles abrade pumping and other producing equipment and reduce the fluid production capabilities of the producing zones in the wells.

Particulate material (e.g., sand) may be present due to the nature of a subterranean formation and/or as a result of well stimulation treatments wherein proppant is introduced into a subterranean formation. Unconsolidated subterranean zones may be stimulated by creating fractures in the zones and depositing particulate proppant material in the fractures to maintain them in open positions.

Gravel packs with sand screens and the like have commonly been installed in wellbores penetrating unconsolidated zones to control sand production from a well. The gravel packs serve as filters and help to assure that fines and sand do not migrate with produced fluids into the wellbore.

Cased-hole gravel packing requires that the perforations or fractures extending past any near-wellbore damage as well as the annular area between the outside diameter (OD) of the screen and the inside diameter (ID) of the casing be tightly packed with gravel. See Brochure: "Sand Control Applications," by Halliburton Energy Services Inc., which is incorporated herein by reference. The open-hole gravel-pack completion process requires only that the gravel be tightly packed in the annulus between the OD of the screen and the openhole.

Several techniques to improve external gravel-pack placement, either with or without fracture stimulation, have been devised. These improved techniques can be performed either with the gravel-pack screen and other downhole equipment in place or before the screen is placed across the perforations. The preferred packing methods are either 1) prepacking or 2) placing the external pack with screens in place, combined with some sort of stimulation (acid-prepack), or with fracturing or acidizing. The "acid-prepack" method is a combination stimulation and sand control procedure for external gravel-pack placement (packing the perforations with gravel). Alternating stages of acid and gravel slurry are pumped during the treatment. The perforations are cleaned and then "prepacked" with pack sand.

Combination methods combine technologies of both chemical consolidation and mechanical sand-control. Sand control by chemical consolidation involves the process of injecting chemicals into the naturally unconsolidated formation to provide grain-to-grain cementation. Sand control by resin-coated gravel involves placing a resin-coated gravel in the perforation tunnels. Resin-coated gravel is typically pumped as a gel/gravel slurry. Once the resin-coated gravel is in place, the resin sets up to form a consolidated gravel filter, thereby removing the need for a screen to hold the gravel in place. The proppant pumped in a frac treatment may be consolidated into a solid (but permeable) mass to prevent proppant-flow back without a mechanical screen and to prevent formation sand production. U.S. Pat. No. 5,775,425, which is incorporated herein by reference, discloses an improved method for controlling fine particulates produced during a stimulation treatment, including the steps of providing a fluid suspension including a mixture of a particulate coated with a tackifying compound and pumping the suspension into a formation and depositing the mixture within the formation.

A combined fracturing and gravel-packing operation involves pumping gravel or proppant into the perforations at rates and pressures that exceed the parting pressure of the formation. The fracture provides stimulation and enhances the effectiveness of the gravel-pack operation in eliminating sand production. The fracturing operation produces some "restressing" of the formation, which tends to reduce sanding tendencies. See Brochure: "STIMPAC Service Brochure," by Schlumberger Limited, which is incorporated herein by reference. The high pressures used during fracturing ensure leakoff into all perforations, including those not connected to the fracture, packing them thoroughly. Fracturing and gravel packing can be combined as a single operation while a screen is in the well.

"Fracpacking" (also referred to as "HPF," for high-permeability fracturing) uses the tip-screenout (TSO) design, which creates a wide, very high sand concentration propped fracture at the wellbore. See M. Economides, L. Watters & S. Dunn-Norman, *Petroleum Well Construction*, at 537–42 (1998), which is incorporated herein by reference. The TSO occurs when sufficient proppant has concentrated at the leading edge of the fracture to prevent further fracture extension. Once fracture growth has been arrested (assuming the pump rate is larger than the rate of leakoff to the formation), continued pumping will inflate the fracture (increase fracture width). The result is short but exceptionally wide fractures. The fracpack can be performed either with a screen and gravel-pack packer in place or in open casing using a squeeze packer. Synthetic proppants are frequently used for fracpacks since they are more resistant to crushing and have higher permeability under high confining stress.

In a typical gravel pack completion, a screen is placed in the wellbore and positioned within the zone which is to be completed. The screen is typically connected to a tool which includes a production packer and a crossover port, and the tool is in turn connected to a work string or production string. A particulate material, which is usually graded sand, often referred to in the art as gravel, is pumped in a slurry down the work or production string and through the crossover port whereby it flows into the annulus between the screen and the wellbore and into the perforations, if applicable. The liquid forming the slurry leaks off into the subterranean zone and/or through the screen which is sized to prevent the sand in the slurry from flowing therethrough. As a result, the sand is deposited in the annulus around the screen whereby it forms a gravel pack. The size of the sand in the gravel pack is selected such that it prevents formation fines and sand from flowing into the wellbore with produced fluids.

Circulation packing (sometimes called "conventional" gravel-packing) begins at the bottom of the screen and packs upward along the length of the screen. Gravel is transported into the annulus between the screen and casing (or the screen and the open hole) where it is packed into position from the bottom of the completion interval upward. The transport fluid then returns to the annulus through the washpipe inside the screen that is connected to the workstring.

Horizontal gravel packs can be placed in open or cased hole completions of varying lengths. The alpha/beta wave approach has been used extensively for gravel packing horizontal wells. See Dickinson, W. et al.: "A Second-Generation Horizontal Drilling System," paper 14804 presented at the 1986 IADC/SPE Drilling Conference held in Dallas, Tex., February 10–12; Dickinson, W. et al.: "Gravel Packing of Horizontal Wells," paper 16931 presented at the 1987 SPE Annual Technical Conference and Exhibition held in Dallas, Tex., September 27–29; and M. Economides, L. Watters & S. Dunn-Norman, *Petroleum Well Construction*, at 533–34 (1998), which are all incorporated herein by reference. This method is a two-step procedure, which includes an alpha wave sand deposition in one direction and a beta wave sand deposition in the opposite direction. Water-based sand slurry is pumped down the vertical work string out the horizontal portion of the screen-casing annulus. A sand dune builds up in the borehole both in the forward direction (away from the vertical borehole) and in the reverse direction (back toward the vertical borehole). The sand dune fills the horizontal borehold annulus to about 50% to over 80% fill (the alpha sand wave deposition). The leading edge of the sand dune progresses toward the toe of the wellbore until it reaches the end of the screen. Then the beta wave deposition of sand in the horizontal borehole begins. The sand movement in the beta deposition occurs in successive waves. However, this approach depends on maintaining a very limited fluid loss. If fluid loss is too great, it will stall the completion of alpha wave development, allowing a beta wave to start or causing a bridge to form that prevents the annular pack from being completed.

A problem often encountered in forming gravel packs, particularly gravel packs in long and/or deviated unconsolidated producing intervals, is the formation of sand bridges in the annulus between the sand retainer screen and the casing wall (for in-casing gravel packs) or the formation (for open-hole gravel packs). Non-uniform sand packing often occurs as a result of the loss of carrier liquid from the sand slurry into high permeability portions of the subterranean zone. This in turn causes the formation of sand bridges before all the sand has been placed. Sand bridges in the interval to be packed prevent placement of sufficient sand below that bridge for top-down gravel packing, or above that bridge for bottom-up gravel packing. When the well is placed on production, the flow of produced fluids is concentrated through the voids in the gravel pack, which soon causes the screen to be eroded, and the migration of fines and sand with the produced fluids to result.

The key to successful frac packs and gravel packs is complete packing of gravel in the fracture, perforations and well annulus. The development of bridges in long perforated intervals or highly deviated wells can end the treatment prematurely, resulting in reduced production from unpacked perforations, voids in the annular gravel pack, and/or reduced fracture width and conductivity.

To prevent the formation of sand bridges and create uniform distribution during gravel packing, "alternate-path" (or "multiple-path") well screens using perforated "shunt tubes" extending along the screen have been proposed. See, e.g., Jones, L. G., et al.: "Alternate Path Gravel Packing," SPE 22796, 1991 and L. Jones: "Spectacular Wells Result From Alternate Path Technology," article reprint from Petroleum Engineer International, which are incorporated by reference herein for all purposes. In these well screens, the alternate-paths (e.g., perforated shunts or by-pass conduits) extend along the length of the screen and are in fluid communication with the gravel slurry as the slurry enters the well annulus around the screen. If a sand bridge forms in the annulus, the slurry is still free to flow through the conduits and out into the annulus through the perforations in the shunt tubes to complete the filling of the annulus above and/or below the sand bridge.

The shunts can be used in multiple intervals isolated by packers. See Brochure: "Alternate Path Service Brochure," by Schlumberger Limited, which is incorporated herein for all purposes. The shunts are compatible with cup-type annular packers. Different sized tubes can be used for treating and packing different intervals. Shunts in different sizes can result in different flow rates.

In many alternate-path well screens, the individual shunt tubes are carried externally on the outer surface of the sand control screen. U.S. Pat. No. 4,945,991, which is incorporated herein by reference, proposes a well screen with perforated shunt tubes attached to the outside of a sand screen. This patent proposed attaching long, perforated shunt tubes to the exterior of the screen to form a continuous shunt path extending along the entire length of the screen, even when the screen was comprised of multiple sections. The shunt tubes were connected together between all sectional lengths of the screen, to provide a continuous flow path along the exterior of the screen sections for the gravel-laden fluid. (The patents and/or other references mentioned in the Background Section are not admitted to be "prior art" with respect to the present invention by their mere mention herein).

External shunt tubes suffer from numerous disadvantages and problems. See, e.g., U.S. Pat. No. 6,220,345 at col. 1, ln. 66-col. 2, ln. 24. Problems with the device of U.S. Pat. No. 4,945,991 are that it is troublesome to hang down the device in the wellbore and it is difficult to lift up the device from the wellbore due to the danger of the well screen sticking to the wellbore. Besides, it is extremely difficult to connect respective shunt tubes attached to the outside of the screen to shunt tubes attached to the outside of a following screen in the course of assembling the screen and lowering it into the wellbore.

Another disadvantage in mounting the shunts externally is that the shunts are exposed to damage during assembly and installation of the well screen. Due to the relative small size of the alternate-path shunt tubes, it is vitally important that they are not crimped or otherwise damaged during the installation of the screen. One proposal for protecting these shunts is to place them inside the outer surface of the sand retainer screen; see, e.g., U.S. Pat. Nos. 5,476,143 and 5,515,915, which are incorporated herein by reference. However, it may be more desirable from an economic standpoint to merely position and secure the by-pass conduits or shunt tubes onto the external surface of a commercially-available sand screen.

U.S. Pat. No. 5,934,376, which is incorporated herein by reference, discloses a new method, called CAPS™, for concentric annular pack screen system, basically comprising the steps of placing a slotted liner or perforated shroud with an internal sand screen disposed therein, in the zone to be completed, isolating the perforated shroud and the wellbore in the zone and injecting particulate material into the annuli between the sand screen and the perforated shroud, and between the perforated shroud and the wellbore to thereby form packs of particulate material therein. The system enables the fluid and sand to bypass any bridges that may form by providing multiple flow paths via the perforated shroud/screen annulus and/or wellbore/screen annulus. See also Lafontaine, L. et al.: "New Concentric Annular Packing System Limits Bridging in Horizontal Gravel Packs," paper 56778 presented at the 1999 SPE Annual Technical Conference and Exhibition held in Houston, Tex., October 3–6, which is incorporated herein by reference.

U.S. Pat. No. 5,890,533, which is incorporated herein by reference, proposes a gravel-pack, well screen having a shunt tube positioned inside the base pipe of the screen. The shunt tube extends substantially throughout the length of the base pipe. A threaded connector or the like is provided on either end of the length of the internal shunt tube to connect the adjacent lengths of shunt tube together.

It is difficult and time consuming to make all the fluid connections between the respective shunt tubes which are required in making-up a typical alternate-path well screen. The use of thread joints to interconnect adjacent lengths or joints of well screen often makes it difficult to circumferentially align each pair of shunt tubes that must be interconnected to maintain axial continuity in the overall shunt flow path. Additionally, a supplemental connection fitting must be used to interconnect and operatively communicate the interiors of each pair of shunt tubes to be connected.

In making-up or assembling many alternate-path, well screens the desired number of joints are secured together by first coupling the "base pipes" of adjacent joints together and then individually, fluidly connecting each of the shunt conduits on a joint to its respective shunt conduit on the adjacent joint. A typical joint normally has a plurality of parallel, axially-extending shunt tubes thereon. Individual connectors are required for making the necessary fluid connections between the shunt conduits of adjacent joints. Typically, the connector is assembled onto the aligned shunt tubes after the joints have been connected together. The respective shunt tubes on adjacent joints must be substantially in axial alignment before a connection can be made. This tedious assembly adds substantially to the time and overall costs involved in using these alternate path well screens.

One proposed technique is contained in U.S. Pat. No. 5,390,966, which is incorporated herein by reference. A connector is provided for connecting the respective, aligned shunt conduits carried by two adjacent joints of a well tool. The shunt tubes are individually, fluidly connected. The connector is slidably positioned on the base pipe at one end of a screen joint. After the base pipes on adjacent joints have been coupled together, the shunt conduits on the joints are aligned and the connector is moved to its "connected position" in a separate operation. The connector is slid downward on the base pipe and over the coupling between the joints. This device still requires that each shunt tube be substantially aligned with its respective shunt tube on an adjacent joint before the connector will function.

U.S. Pat. No. 5,868,200, which is incorporated herein by reference, discusses an alternate-path, well screen made-up of joints and having a sleeve positioned between the ends of adjacent joints which acts as a manifold for fluidly-connecting the alternate-paths on one joint with the alternate-paths on an adjacent joint. The alternate flowpaths (e.g., shunt tubes) have a plurality of openings spaced along their length, extend longitudinally along the length of the joint and are open at both ends. The alternate flowpaths are positioned about the external surface of the screen. The sleeve extends between the adjacent joints, so that it surrounds the lower ends of the upper shunt tubes and the upper ends of the lower shunt tubes. The sleeve is connected at one end to the lower end of the upper screen joint and at its other end to the upper end of the lower screen joint.

Another problem that may arise in typical alternate-path well screens is in maintaining adequate and consistent flow of fluid through the relatively small perforations (or "exit ports") at each of the delivery points along the lengths of the bypass tubes. For example, the flow of the gravel-laden slurry in a gravel pack operation is substantially parallel to the axis of the delivery or shunt tubes until the slurry reaches the respective exit ports along the length of a shunt tube. The flow must then make a "right-angle" turn before it can flow through a respective exit port. This results in a tendency for at least some of the particulates (i.e., sand) to by-pass the ports. This, in turn, causes the sand concentration of the carrier fluid to build-up inside the shunt tube thereby adversely affecting the distribution of the gravel pack. In fracturing operations, at least a portion of any particles (e.g., sand) in the fracturing fluid will have the same tendency to by-pass the exit ports and build-up within the delivery conduit of the tool. This results in a diluted fracturing fluid (i.e., lower concentration of sand) being delivered through the exit ports. Further, in order to maintain the proper pressures at each level along the tool and to prevent premature dehydration of the slurry, each of the exit ports must be relatively small. Unfortunately, the small size (e.g., diameter) of the exit ports severely restricts the volume of fracturing fluid, which can be delivered to each fracturing level thereby further adversely affecting the fracturing operation. Too many holes will provide too much leak-off from the shunts and reduce shunt fluid velocities. Plugging of smaller shunt holes is also a problem.

Of course, non-uniform concentration of sand being delivered through the individual alternate-paths is also a problem when the slurry flowing in some of the bypass conduits attains a high sand concentration, e.g., due to excessive fluid loss to the unconsolidated formation, while in other conduits the slurry has a higher fluid content.

Thus, there are needs for improved methods and apparatus for completing wells, including providing a simpler, more cost-effective system that uses the alternate path or "bridging bypass" phenomenon to enhance gravel packing and fracturing operations.

SUMMARY

The present invention provides improved methods and apparatus for completing wells, including gravel packing, fracturing and frac packing operations, which meet the needs described above and overcome the deficiencies of the prior art. The present invention provides an alternate-path, well screen without requiring that the alternate paths (e.g., bypass tubes or conduits) on adjacent joints of screen be axially aligned or individually connected. This allows the joints to be made-up quickly which speeds up the assembly and installation of the alternate-path, well screen.

Improved methods are provided including the steps of placing in the wellbore a perforated shroud (liner) having an internal sand screen therein (e.g., screens, screened pipes, slotted liners, prepacked screens, etc.), positioning about the perforated liner an alternate flowpath comprised of a plurality of "bypass" tubes or conduits having inlet passages or portions adapted to receive the gravel slurry as it reaches the apparatus and outlets for the slurry to reach the well annulus, and injecting particulate material (e.g., slurry) into the wellbore wall/perforated liner annulus and perforated liner/screen annulus, whereby the particulate portion of the slurry is uniformly packed into the two annuli. The permeable pack of particulate material formed prevents the migration of formation fines and sand with fluids produced into the wellbore from an unconsolidated zone.

The bypass tubes may be positioned inside the perforated shroud or liner (externally of the sand screen) or outside the perforated shroud. If the tubes are located inside the perforated shroud (liner), no structure projecting outside the perforated shroud (liner) is provided and therefore, the danger of the perforated shroud sticking to the wellbore when the perforated shroud is lowered or lifted through the wellbore is minimized.

In one aspect of the invention, alternate flowpaths comprising relatively short, blank tubes are attached inside the perforated liner (externally of the sand screen). The tubes extend in the axial direction of the perforated shroud and are spaced at predetermined intervals in the circumferential direction of the shroud. For purposes of this embodiment, the term "blank tube" denotes a structure forming an elongated, closed fluid passageway effectively having only two spaced opening points for flow into and out of the passageway.

The tubes have inlet passages or portions adapted to receive the gravel slurry as it reaches the apparatus and outlets to direct the slurry to the interval. The upper and/or lower ends of the tubes may (but are not required to) be open and/or have a tapered, arcuate or beveled shape. In one example, the open, lower ends of the bypass tubes comprise the outlets for the slurry to reach the well annulus. Each of the tubes extends only a portion of the length of the shroud, so the tube outlets (e.g., open lower ends of the respective tubes) are spaced at intervals along the length of the shroud. The bypass tubes or conduits provide alternate flow paths for the sand-laden fluid to reach the well annulus via outlets which are relatively larger in area (than the shunt-tube perforations used to deliver the slurry in typical alternate-path well screens), so larger volumes of fluid can be delivered and premature dehydration of the slurry and/or sand build-up within the tubes is inhibited.

The use of the relatively larger (in area) open, lower ends of the bypass tubes to deliver the slurry to the well annulus alleviates the problem of the exit ports along the length of a typical shunt tube often becoming blocked with sand prior to the completion of the operation. For example, if a sand bridge forms in the annulus between the perforated liner and the wellbore, the slurry is still free to flow through the tubes and out into the annulus through the outlets of the tubes to complete the filling of the annulus above and/or below the sand bridge.

The present alternate-path, well screen can be comprised of one or more basically identical pipe joints ("screen units" or "screen joints"). A threaded coupling or the like may be provided on either end of the pipe joints to connect adjacent joints together. The improved well screen may have a crossover sub or the like attached at its upper end which, in turn, is connected to and suspended in the wellbore by a work string or tubing string.

The bypass tubes are mounted or attached to the perforated liner or shroud. In one aspect of the invention, the tubes are not directly attached to the sand control screen, and the sand screen can be simply slid down inside the perforated shroud during its placement at the wellsite. The perforated shroud has a plurality of openings in the wall thereof to allow fluid from the outlets of the bypass tubes to flow through the shroud and into the well annulus during a gravel pack operation and for fluids to flow into the shroud and through the sand screen during production.

The sand control screen located inside the perforated shroud can be an expandable-screen type screen. The expandable screen can be expanded all the way out to the inside wall (ID) of the perforated shroud, allowing the screen to obtain maximum size if desired. The inner annulus between the shroud and the expanded screen no longer exists, but the alternate flow paths are provided via the attached tubes on the shroud. The number of holes or the hole size on the shroud can be increased to minimize flow restriction into the screen during well production.

In another aspect of the present invention, a plurality of axially-spaced "bundles" or series of circumferentially-spaced, axially-extending conduits (e.g., bypass tubes) are provided along the perforated shroud. In one embodiment, the individual bypass tubes comprising each series of conduits are generally parallel to one another and substantially the same length. A connector (or "mixer") is positioned between adjacent tube series which fluidly connect the tubes (as a group) in one series with the tubes in an adjacent series. The connectors may be spaced at intervals along the shroud instead of being located only at the joints between adjacent screen units. The connectors can be separately formed, or they can be formed together with the perforated shroud (liner). At the location of the connectors, the shroud has no perforations but becomes a liner to provide isolation for mixing, and there is no opening between the perforated shroud and the connector. The connectors allow the slurry being transported down the individual bypass tubes to be mixed at intervals prior to entering the tubes below. The bypass tubes need not be individually axially-aligned or fluidly connected with one another. The tubes have inlets for receiving slurry flow. The connectors may have outlet portions for the slurry to reach the well annulus. Where the perforated shroud is of a substantial length, or the distance between connectors is substantial, the bypass tubes preferably have at least one outlet along their length for the slurry to reach the wellbore.

The present methods can be combined with other techniques, such as prepacking, fracturing, chemical consolidation, etc. The methods may be applied at the time of completion or later in the well's life. The unconsolidated formation can be fractured prior to or during the injection of the particulate material into the unconsolidated producing zone, and the particulate material can be deposited in the fractures, as well as in the wellbore/shroud and shroud/screen annuli.

The improved methods and apparatus of this invention provide a simpler, more cost-effective system with multiple paths, so that a slurry can bypass any premature annulus bridges that form during gravel packing or frac packing and halt the packing process. The system may be used in long intervals and variable formations.

Other and further objects, features and advantages of the present invention will be readily apparent to those skilled in the art upon a reading of the description of preferred embodiments which follows when taken in conjunction with the accompanying drawings, in which:

DETAILED DESCRIPTION OF THE INVENTION

The present invention provides improved methods and apparatus for completing, and optionally simultaneously fracture stimulating, a subterranean zone penetrated by a wellbore. The methods can be performed in either vertical, deviated or horizontal wellbores which are open-hole or have casing cemented therein. If the method is to be carried out in a cased wellbore, the casing is perforated to provide for fluid communication with the zone. Since the present invention is applicable in horizontal and inclined wellbores, the terms "upper and lower," "top and bottom," as used herein are relative terms and are intended to apply to the respective positions within a particular wellbore, while the term "levels" is meant to refer to respective spaced positions along the wellbore.

Figure 1:
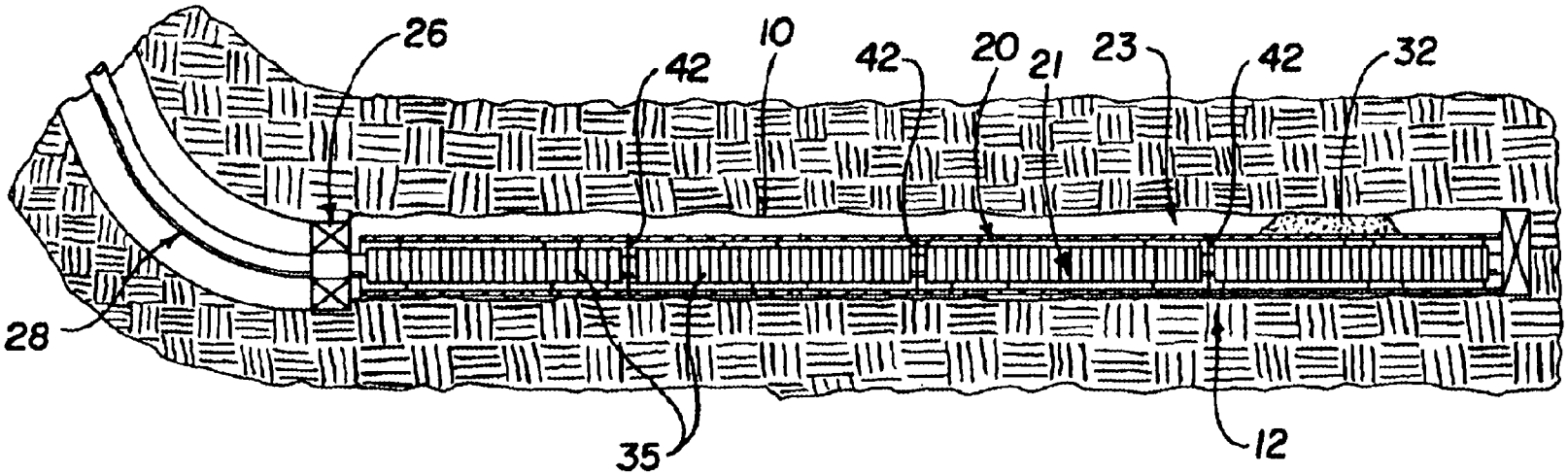
FIG. 1 is a schematic view of an alternate-path, well screen embodying principles of the present invention placed in an eccentric position within a horizontal open-hole wellbore.

Referring more particularly to the drawings, FIG. 1 illustrates a horizontal open-hole wellbore 10. The wellbore 10 extends into an unconsolidated subterranean zone 12 from a cased wellbore extending to the surface. As mentioned, while wellbore 10 is illustrated as a horizontal open-hole completion it should be recognized that the present invention is also applicable to vertical-cased wellbores; e.g., as illustrated in U.S. Pat. No. 5,341,880, which is incorporated herein by reference.

Alternate-path, well tool 15 is located inside wellbore 10. Well tool 15 has a "crossover" sub connected to its upper end, which is suspended from the surface on a tubing or work string (not shown). A packer such as packer 26 may (but is not required to) be attached to the crossover. The crossover and packer 26 are conventional gravel pack forming tools and are well known to those skilled in the art. The packer 26 may be used to isolate the wellbore wall/perforated liner annulus and permit fluid/slurry to crossover from the workstring to the perforated liner/sand screen annulus during packing. (Of course, the packer 26 is optional and may be dispensed with, and the slurry injected into both annuli during packing). The crossover provides channels for the circulation of proppant slurry to the outside of the screen, and returns circulation of fluid through the tool 15 and up the washpipe 40. The washpipe 40 is attached to the gravel pack service tool and is run inside the well tool 15. The washpipe 40 is used to force fluid to flow around the bottom of the tool 15.

Well tool 15 may be of a single length or it may be comprised of a plurality of screen "joints" 35 which are connected together with threaded couplings or the like (not shown). As shown, each of the screen joints 35 is basically identical to each other and each is comprised of a perforated base pipe 36 having a continuous length of wrap wire 37 wound thereon, which forms a sand screen section 21 therein.

The term "screen" is used generically herein and is meant to include and cover all types of similar structures which are commonly used in gravel pack well completions which permit flow of fluids through the "screen" while blocking the flow of particulates (e.g., other commercially-available screens; slotted or perforated liners or pipes; sintered-metal screens; mesh screens; screened pipes; pre-packed screens, expandable-type screens and/or liners; or combinations thereof).

Figure 2:
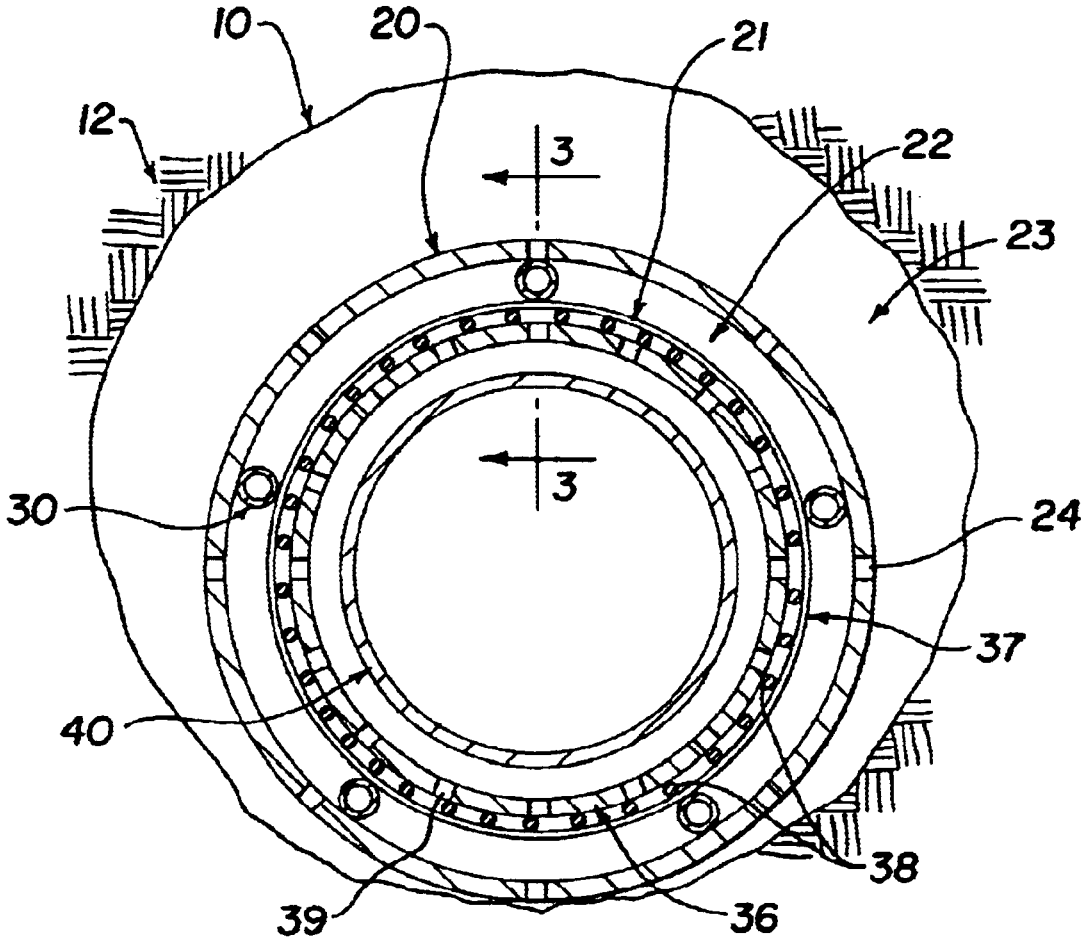
FIG. 2 is a cross-sectional view of the tool of FIG. 1.
Figure 3:
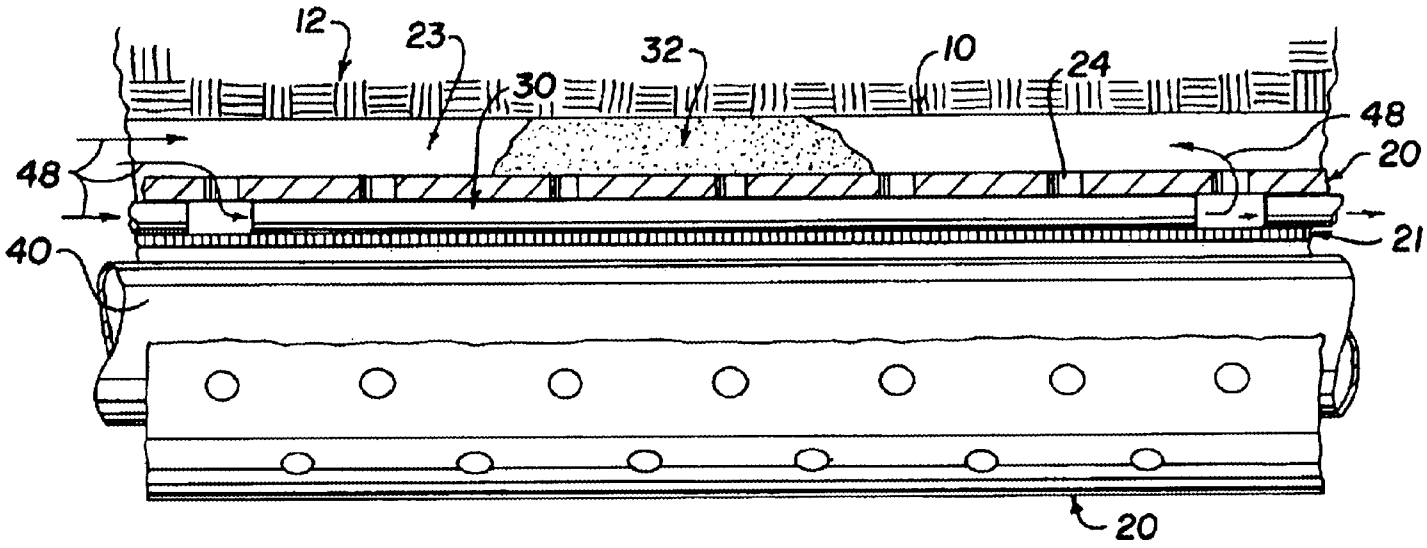
FIG. 3 is a partial sectional view taken along line 3—3 in FIG. 2, looking in the direction of the arrows.
Figure 4:
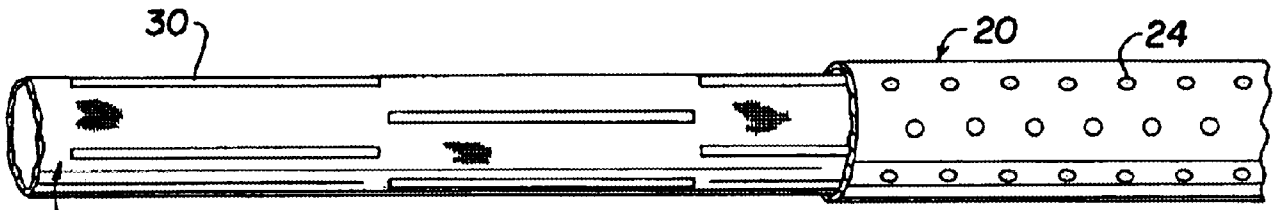
FIG. 4 is a broken-away view of a tool having a perforated shroud with an internal sand screen and multiple flowpaths in accordance with an aspect of the present invention.

In the embodiment shown in FIG. 2, well tool 15 includes a perforated shroud 20 having an internal sand screen 21 disposed therein. Multiple flowpaths comprised of a plurality (five shown) of relatively short, blank (e.g., non-perforated) "bypass" tubes or conduits 30 are mounted or attached to the inner surface of shroud 20, externally of sand screen 21. Tubes 30 may (but are not required to) be radially spaced at intervals, generally parallel to each other and extending axially along shroud 20 as shown in the drawings. Each of the tubes 30 extends only a portion of the length of the perforated shroud 20 on each screen joint 35. The tubes 30 typically have parameters of about ⅜ inch to 1-inch ID and 4 to 20 feet in length. Tubes 30 may be of equal lengths (as shown) or they may be of different or varying lengths. Although the tubes 30 may be made of any pressure-resistant material, they are preferably made of stainless steel.

As shown, the blank tubes 30 are open at their upper ends 34 and lower ends 33 to establish fluid communication between tubes 30 and the wellbore wall/perforated liner annulus and perforated liner/screen annulus. Although in the illustrated embodiments the tube openings (e.g., the tube inlet and outlet passages or portions) are located at the upper and lower ends of the tubes, it is to be understood that either or both of the tube openings could be spaced from the ends. These openings are sized to permit blank tubes 30 to receive the gravel slurry as it reaches the apparatus and direct the slurry to the interval of the wellbore being completed.

A perforated shroud 20 is comprised of a cylinder made of a strong, durable material, such as steel. Perforated shroud 20 may be secured to joint 35 such as by support rings (not shown) at its upper and lower ends, or other suitable means. Perforated shroud 20 is of a diameter such that when it is disposed within the wellbore 10 an annulus 23 is formed between it and the wellbore 10. Perforated shroud 20 has perforations or slots 24 which can be circular as illustrated in the drawings, or they can be rectangular, oval or other shapes. Shroud perforation size should be engineered based on the rheology of the carrier fluid, the pump rate and production considerations. Generally, when circular slots are utilized they are at least ¼ in. in diameter, and when rectangular slots are utilized they are at least ¼ in. wide by ½ in. long.

Blank tubes 30 may be located inside shroud 20 as shown in FIG. 2, or they may be outside shroud 20. However, tubes 30 are preferably positioned within shroud 20 to protect them from damage and abuse during handling and installation of the well tool 15. The well tool 15 will slide on the smooth surface of the shroud 20 during installation, and the tubes 30 won't be dragged on the rugged wellbore wall, layered with mud cake. Tubes 30 can also act as centralizers for the sand screen 21 if they are installed inside shroud 20. Of course, the shroud 20 also protects internal sand screen 21 during installation of the tool in the wellbore, such as from invasion of mud cake or mechanical damage.

Blank tubes 30 can be round as shown in the drawings, or they can have other shapes, such as oval, square, rectangular, polygonal, etc. In some instances, round tubes are preferably used since it is easier and less expensive to manufacture round tubes and a round tube has a greater and more uniform burst strength than a comparable rectangular tube. Tubes 30 can be separately formed or perforated shroud 20 may be utilized as part of the structure constituting the tubes 30 so that material can be saved and the screen structure can be simplified, and the weight of the screen can be held at a minimum. The number of tubes 30 used can be one or more, but at least four are preferably used.

Figure 5A:
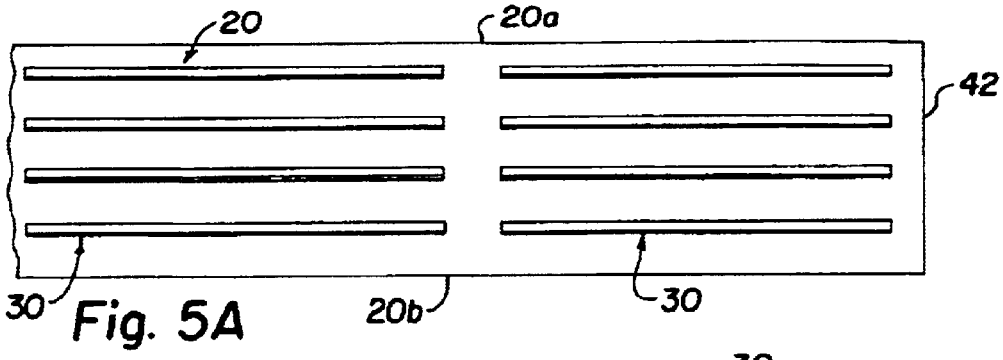
FIGS. 5A to 5D show shrouds (e.g., perforated liners) laid flat prior to being formed into a cylindrical shape and various configurations and/or arrangements of blank tubes thereon, in accordance with an aspect of the present invention.

Blank tubes 30 can be comprised of a variety of different configurations and/or arrangements. Tubes 30 may be axially aligned (e.g., directly across from each other), or they may be offset. Tubes 30 may be configured, for example, in any one or more of the arrangements shown in FIGS. 5A to 5D or combinations thereof. In these figures, the shroud 20 is shown as a perforated sheet of rigid material prior to rolling the sheet into a cylindrical or tubular shape. The sheet material is formed into a cylindrical shape with edges 20*a* and 20*b* abutting and welded together. It is anticipated that tubes 30 preferably are welded to the sheet material forming shroud 20 before the material is formed into a cylinder. In FIG. 5A, the tubes 30 are shown arranged in a parallel pattern with the respective upper and lower ends 34 and 33 of adjacent tubes aligned. If the tubes 30 are axially aligned the facing ends of adjacent tubes are spaced apart a sufficient distance to cause the slurry exiting one tube to mix with the surrounding material before entering the adjacent axially aligned tube. If tubes 30 are axially aligned, the facing end portions of each axially adjacent pair of tubes 30 are preferably spaced at least ¼ inch apart. The axial spacing of the ends of the blank tubes 30 allows screen joints 35 to be made-up (connected) without necessity of connecting the tubes 30 on adjacent joints 35 (also see FIG. 1).

Figure 5B:
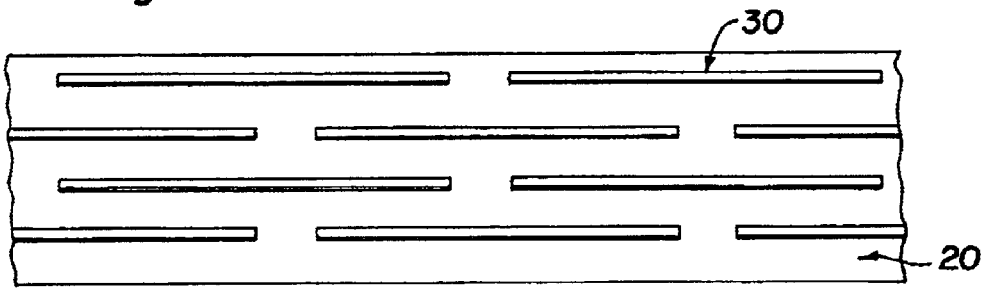
Figure 5C:
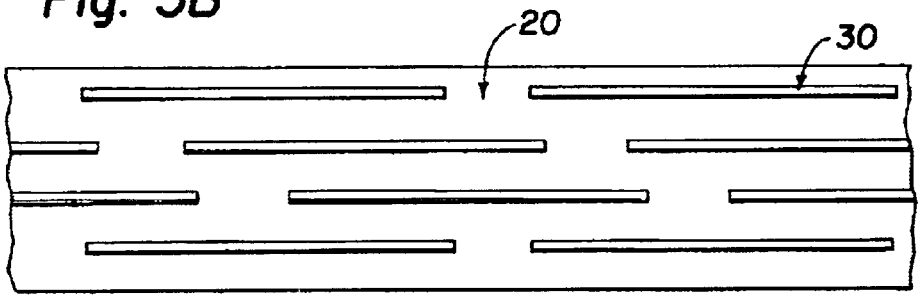
Figure 5D:
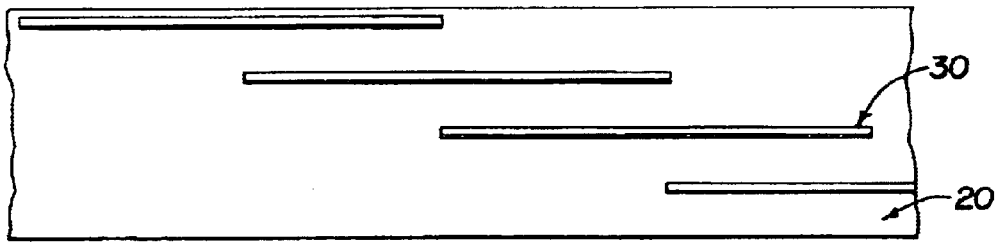
Figure 5E:
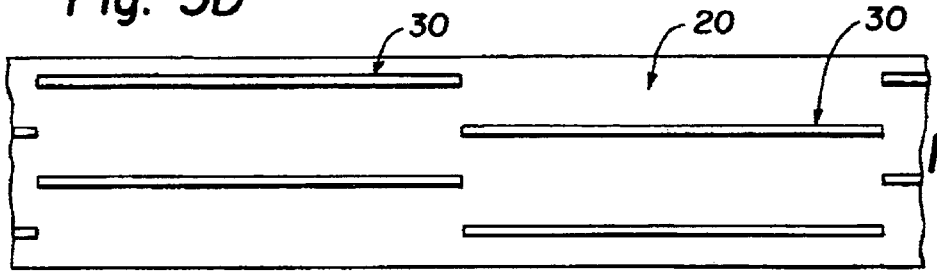

The configuration of FIG. 5A could be included with other patterns such as those shown in FIGS. 5B–5E. In FIG. 5B the tubes in circumferentially-adjacent rows of tubes 30 are staggered and terminate at different levels along the shroud. The tube ends in the adjacent rows of aligned tubes are axially offset one-half the length of the tubes. In FIG. 5C the tube ends are arranged in plural spiral patterns. In FIG. 5D the tubes are in a single spiral pattern. In FIG. 5E the tubes are not axially aligned to thereby enhance mixing caused by fluid exiting one tube and entering the next adjacent tube. In this aspect of the invention, all these configurations have in common the fact that the multiple flow paths are provided via a series of blank tubes (shown without intermediate openings) with each tube extending only a portion of the length of the shroud 20. These features are believed to enhance gravel placement (e.g., more consistent flow of slurry, including concentration of sand being delivered, larger volumes of fluid, etc.) and screen assembly.

The upper and lower ends 34 and 33, respectively, of blank tubes 30 can have a tapered, arcuate or beveled shape. For example, in FIG. 6 the ends 34, 33 of the tubes 30 are shown beveled at about 45 degrees. The tubes 30 are shown attached to the inside of the perforated shroud 20 and spaced from the outer surface of the sand screen 21. In FIG. 7 the tubes are spaced from the inner surface of the perforated shroud 20 and the tube ends 34, 33 are beveled in the opposite direction. However, while the ends of the tubes 30 may be tapered, arcuate or beveled, they are not limited to such shape.

Figure 6:
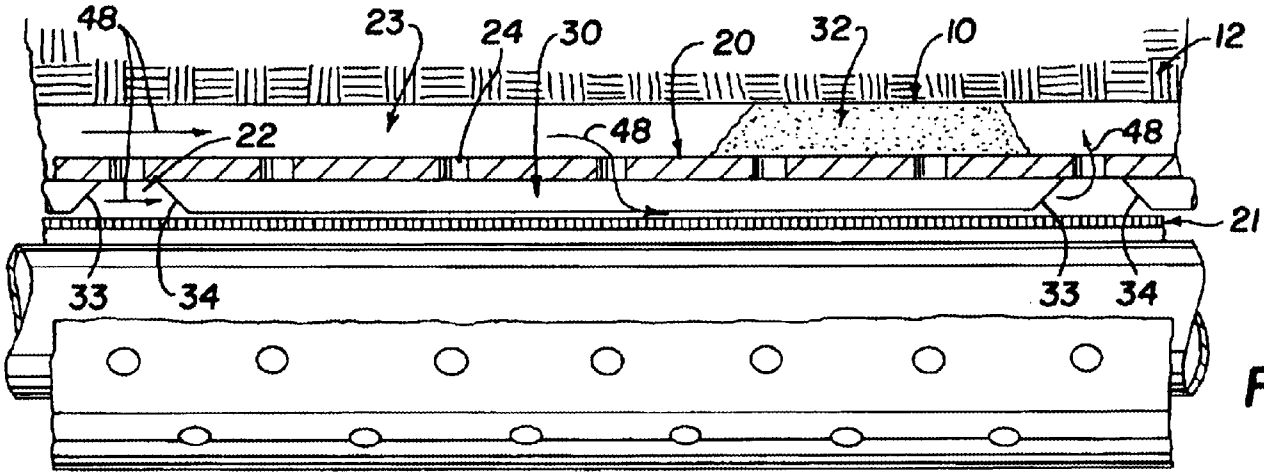
FIG. 6 is a partial sectional view similar to FIG. 3, but showing the blank tubes attached to the inside of the perforated shroud spaced from the outer surface of the sand screen, with the ends of the tubes having a tapered or beveled shape.
Figure 7:
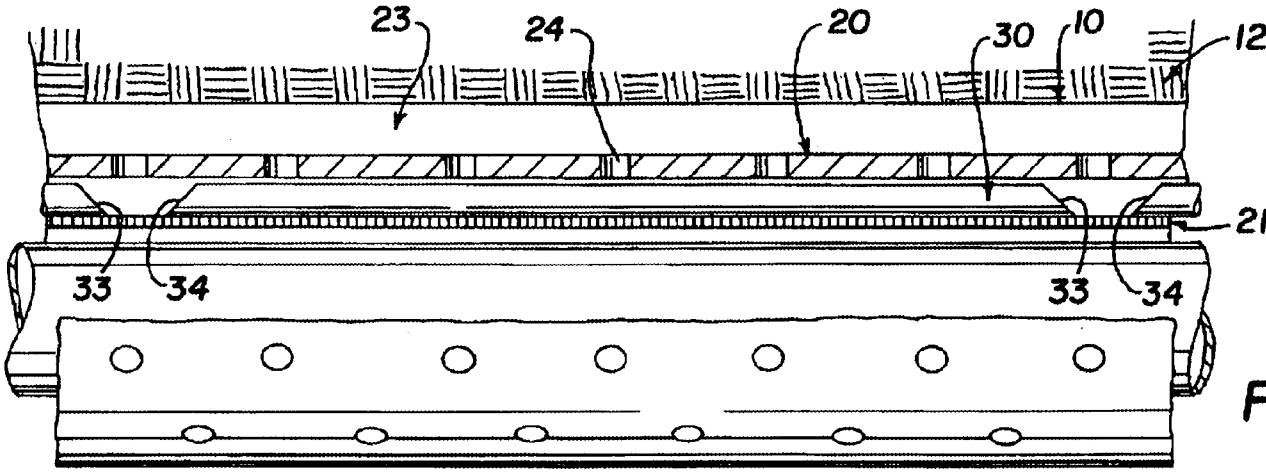
FIG. 7 is similar to FIG. 6, but showing the blank tubes spaced from the inner surface of the perforated shroud with the tube ends beveled in the opposite direction.
Figure 8:
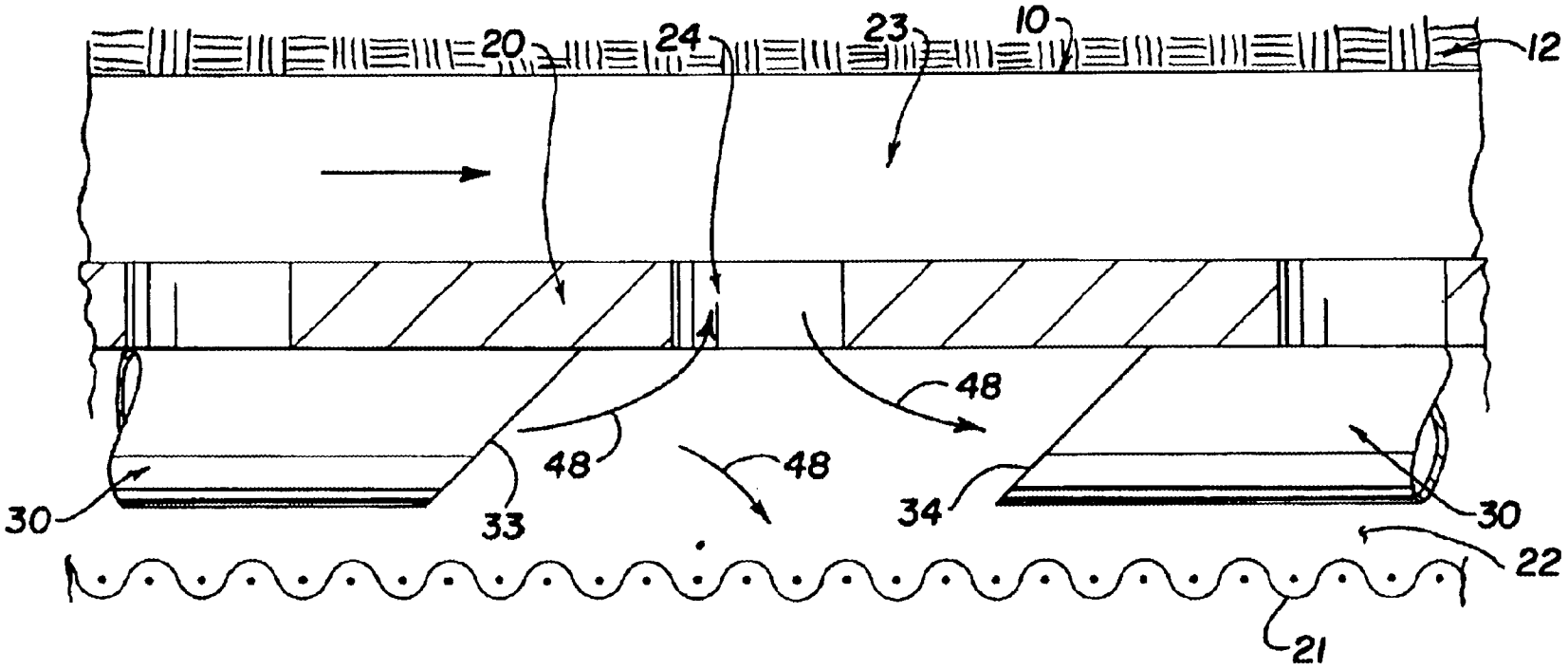
FIG. 8 is a detail view of another configuration for the facing ends of an axially adjacent pair of blank tubes like those shown in FIG. 6.
Figure 9:
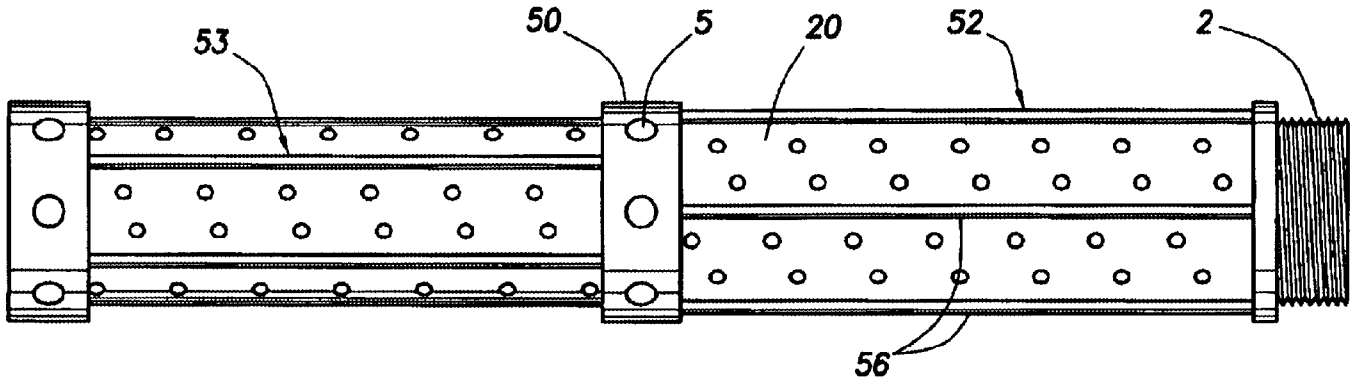
FIG. 9 shows a well tool in accordance with another aspect of the present invention having connectors for fluidly connecting adjacent bundles or pluralities of bypass conduits carried by a joint of the tool.
Figure 14:
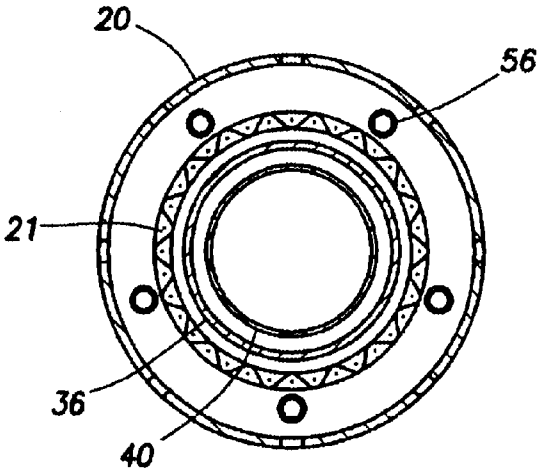
FIG. 14 is similar to FIG. 13 but showing the bypass tubes located inside the perforated shroud.
Figure 13:
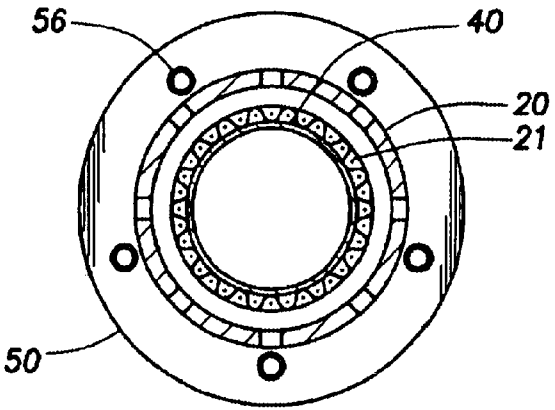
FIG. 13 is a cross-sectional view of a well tool like the one shown in FIG. 9 with the bypass tubes located outside the perforated shroud.
Figure 10:
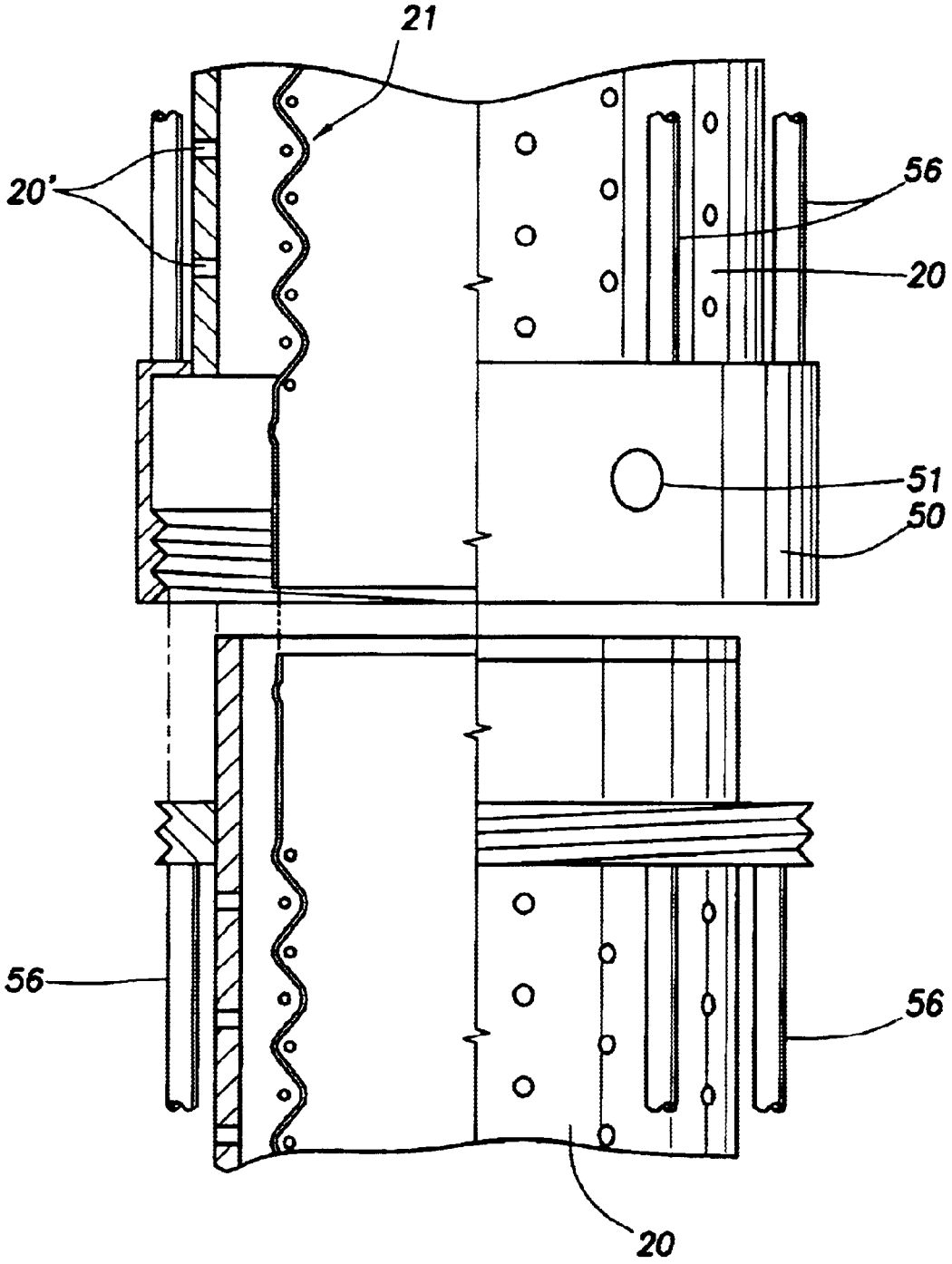
FIG. 10 is a broken-away, partial sectional view of the tool of FIG. 9, showing details of one of the connectors for fluidly connecting adjacent series of bypass tubes or conduits.

In FIG. 8 an alternate configuration for the facing ends 34 and 33 of an axially aligned pair of tubes 30 like those shown in FIG. 6 is depicted in detail. The beveled discharge end 33 and beveled intake end 34 of the adjacent tubes are parallel to enhance mixing. The arrows 48 are illustrative of flow exiting end 33 and mixing with slurry via shroud perforations 24 to cause uniform distribution of gravel in annular space 23.

In accordance with one aspect of the present invention (e.g., FIGS. 1–6), well tool 15 is assembled and lowered into wellbore 10 on a workstring 28 and is positioned adjacent formation 12. A packer such as packer 26 (if present) can be set to isolate the annulus 23 between the perforated shroud 20 and the wellbore 10 as will be understood in the art. (Packer 26 is optional, and, if desired, the slurry may be injected into both the wellbore wall/perforated liner annulus 23 and the perforated liner/screen annulus 22 during packing). Gravel slurry shown as arrows 48 is then pumped down the workstring 28, out through a crossover or the like (not shown), and into the annulus 22 between sand screen 21 and shroud 20. Flow continues into the annulus 23 between shroud 20 and the wellbore 10 by way of perforations 24 in shroud 20. The upper ends 34 of tubes 30 are open to receive flow 48 of the gravel slurry as it enters annulus 22.

Instead of injecting the gravel slurry down annular sections 22 and 23 for packing, as described above, the slurry may alternatively be injected down the interior of the well tool 15 and up the annular spaces 22, 23 to be packed in accordance with gravel packing techniques known in the art. In still another embodiment, all of the gravel or sand slurry may be pumped only through the tubes 30, e.g., the upper ends of the tubes 30 may be manifolded together and connected to the outlet ports in the crossover so that the slurry flows directly into the tubes for distribution in the interval. The wellbore/perforated liner annulus 23 and perforated liner/screen annulus 22 can be packed by using the tubes 30 to divert gravel pack slurry 27 along the entire interval to be packed.

Methods of the present invention are also applicable to placing a gravel pack in a cased and perforated well drilled in an unconsolidated or poorly consolidated zone. In this aspect of the invention, the particulate material is caused to be uniformly packed in the perforations in the wellbore, as well as within the annulus between the sand screen and the perforated liner and the annulus between the liner and the casing. Positioning a conduit or plurality of conduits in juxtaposition with the perforated liner in accordance with the present invention provides separate flow paths to permit gravel pack slurry to bypass sand bridges which might build up during gravel packing or frac packing and halt the packing process.

Conventional sand control screens or premium screens, such as POROPLUS™ sintered-metal screens by Purolator Facet, Inc., Greensboro, N.C., can be pre-installed inside the perforated shroud before being brought to the well site. The perforated shroud provides protection to the screen during transport. The screens also can be slid down inside the perforated shroud at the wellsite. The perforated shroud prevents the screen from contacting the formation wall, minimizing it from damage or plugging.

Figure 11:
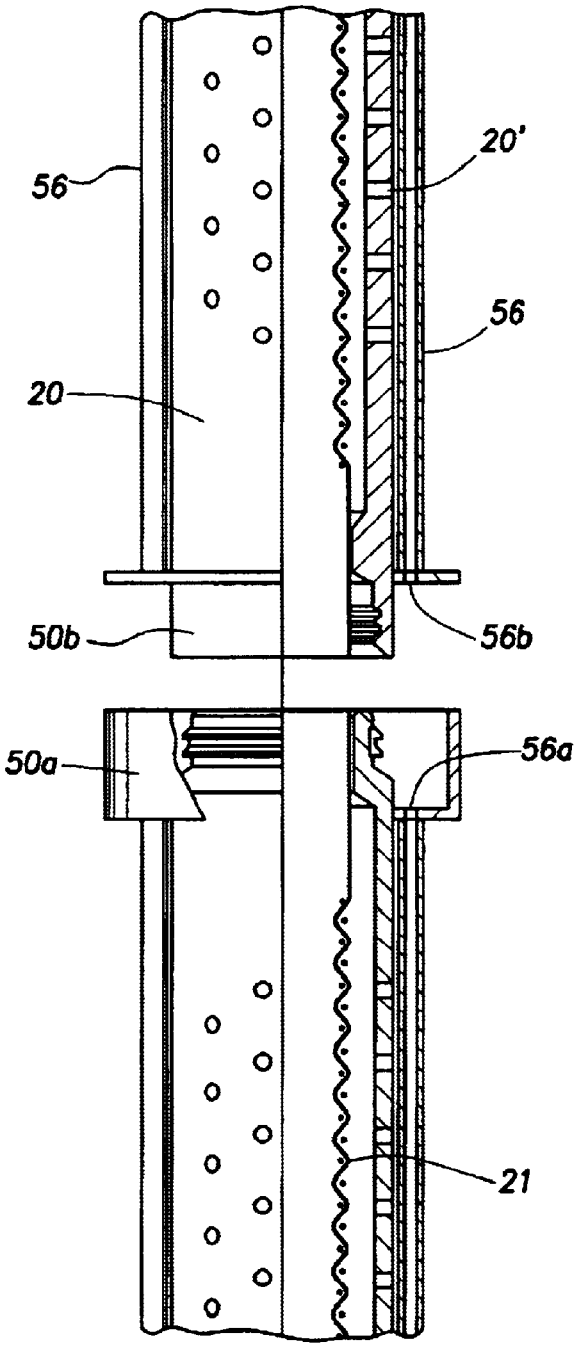
FIGS. 11 and 12 are broken-away views, partly in section, showing the connector of FIG. 10 in a disconnected position and then in a second or connected position.
Figure 12:
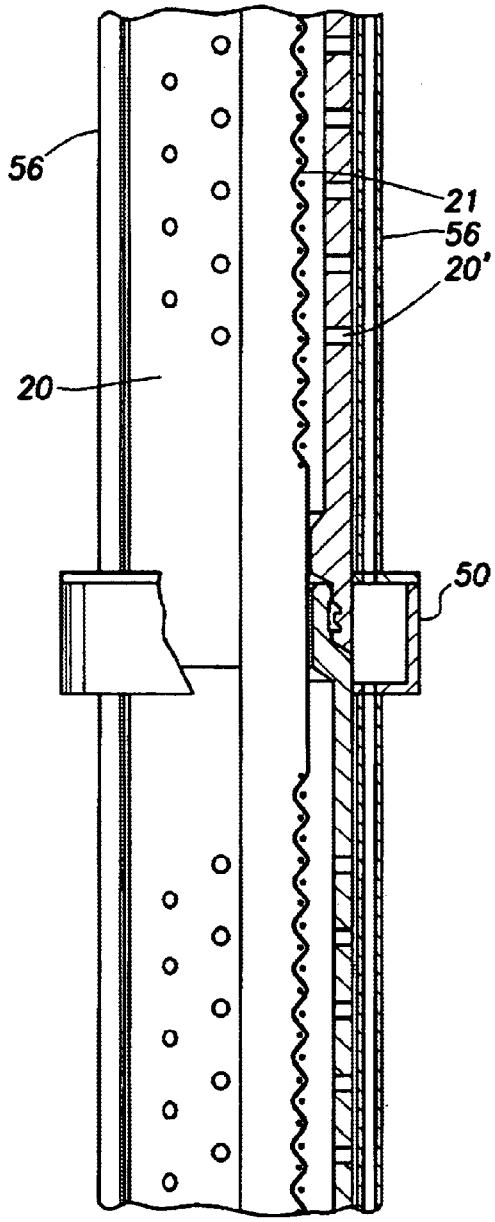

FIGS. 9–14 illustrate a further aspect of the present invention. Axially-spaced upper and lower tube series 52 and 53, respectively, of radially-spaced, axially-extending bypass tubes 56 are provided about the shroud 20. (As shown in FIG. 11, shroud 20 has perforations 20'). A connector (or "mixer") 50 is positioned between adjacent tube series 52 and 53 which fluidly connects the bypass tubes 56 in series 52 and series 54. The connectors 50 may be spaced at intervals along the perforated shroud 20 (e.g., instead of being located only at the joints between adjacent screen units). The connectors 50 can be separately formed or, as shown, they may be formed together with shroud 20. In one aspect of the invention (e.g., as shown in FIGS. 9–14), the space between the outer periphery of the slotted liner and the inner periphery of the connector functions as a space for fluidly connecting the adjacent series of conduits. At the location of the connectors, the shroud has no perforations but becomes a liner to provide isolation for mixing, and there is no opening between the perforated shroud and the connector. The connectors 50 allow the slurry being transported down the bypass tubes in upper tube series 52 to be mixed prior to entering the tubes in lower series 53. These features are believed to provide a more consistent flow of slurry, including concentration of sand being delivered, etc.

In these embodiments, the individual bypass tubes 56 and 58 also need not be axially-aligned or directly connected with one each other. The tubes 56 have inlets 56*a* and outlets 56*b*. The connectors 50 can have outlet portions or passages 51 for the slurry to reach the well annulus. Where the perforated shroud 20 is of a substantial length or the distance between connectors 50 is substantial, the bypass tubes 56 preferably have at least one outlet 58 along their length for the slurry to reach the wellbore. Various options of locating the outlet or exit ports in the tubes or in the connectors are represented in the drawings.

If the connector 50 is separately formed, it may be affixed to the perforated shroud 20 in a variety of ways. Connector 50 can be threaded, welded or otherwise secured (e.g., screws, welding, bands, etc.) to shroud 20. Connector 50 can be made in two or more parts secured together. For example, connector 50 can have a lower end 50*a* secured to shroud 20 and an upper end 50*b* that is threaded onto the lower end 50*a* as the connector is being assembled. If the connectors are located at the joints between adjacent screen units, the connectors may be secured together while the adjacent joints are coupled together. Sealing means (e.g., O-rings or the like, not shown) can be provided at appropriate places between connector 50 and shroud 20 to prevent any excessive leakage at the connections between adjacent tube series.

The bypass tubes 56 can be attached to the perforated shroud 20 and to the connector (or mixer) 50 as a package prior to shifting to the wellsite and readying for down-hole placement. The perforated liner 20 may be placed in the hole first, with the bypass tubes 56 already attached to it. The sand control screen 21 is then simply slid down inside the perforated shroud 20 during its placement.

Figure 15:
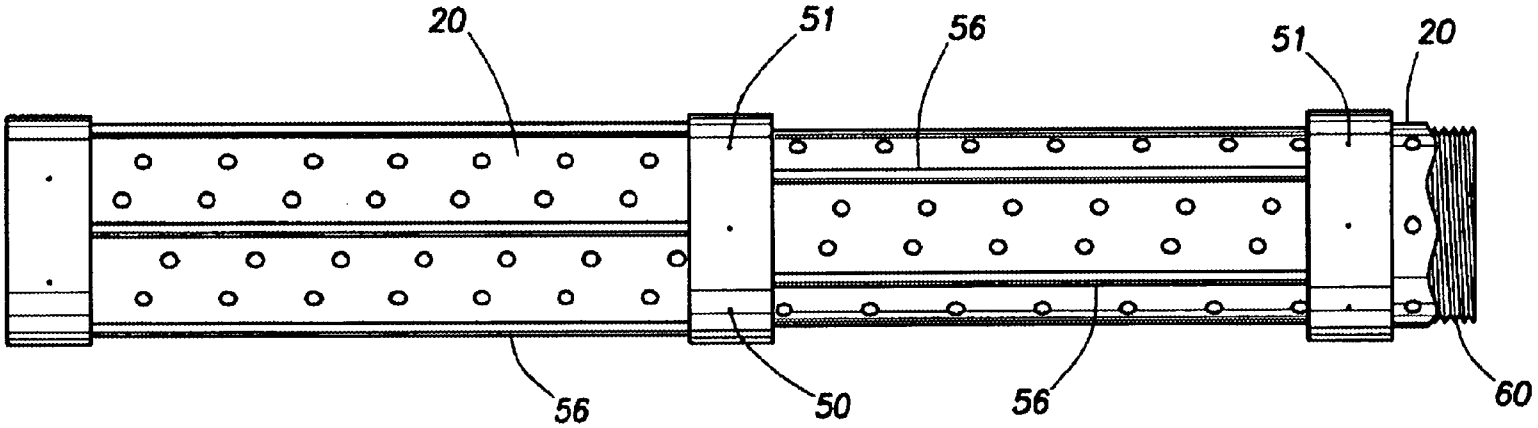
FIGS. 15–17 show a well tool in accordance with the present invention having connectors for fluidly connecting adjacent pluralities of conduits with an expandable-type sand control screen located inside the perforated shroud, and various options of locating the outlet or exit ports in the bypass tubes and/or the connectors.
Figure 16:
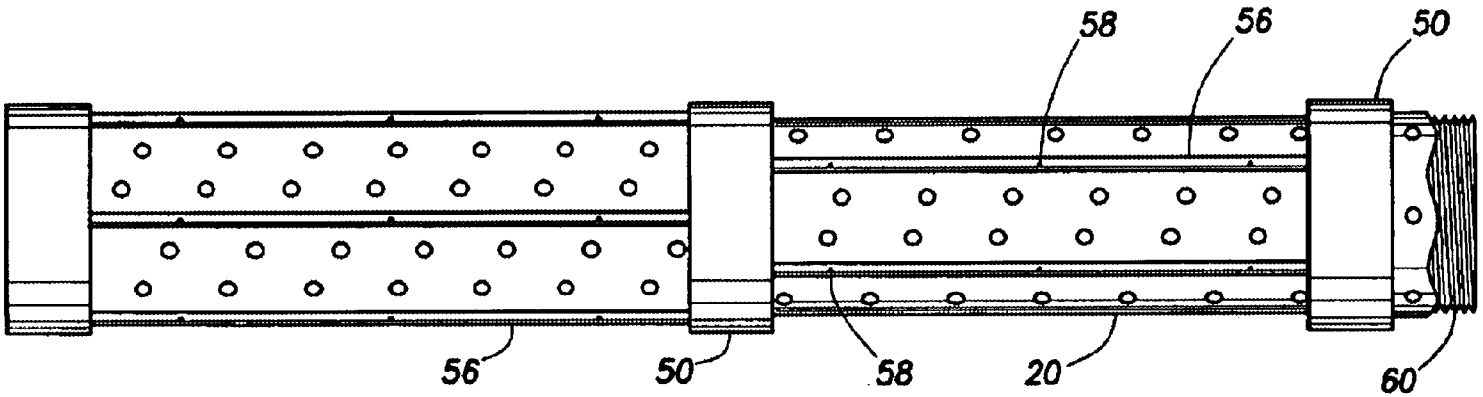
Figure 17:
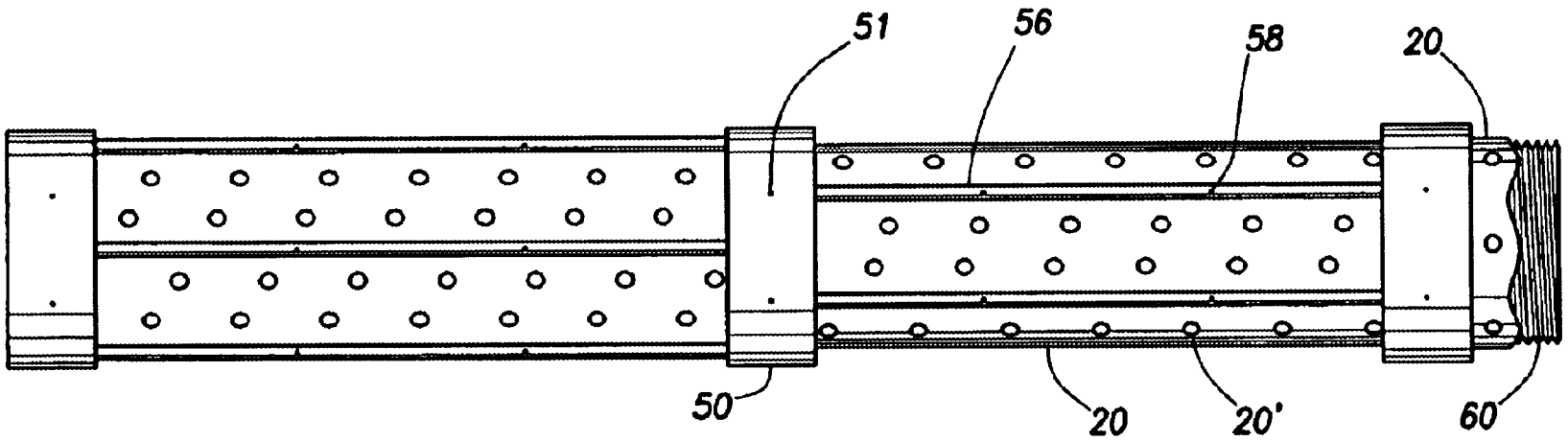

In FIGS. 15–17 the sand control screen located inside the perforated shroud 20 is shown as expandable-type screen 60. The expandable screen 60 can be expanded all the way out to the inside wall (ID) of the perforated shroud 20, allowing the screen 60 to obtain maximum size if desired. The inner annulus between the shroud and the expanded screen no longer exists, but the alternate flow paths are provided via the bypass tubes 56 on the shroud 20. The number of holes or the hole size on the shroud 20 can be increased to minimize flow restriction into the screen during well production.

Expandable-type screens are commercially available, e.g., POROFLEX™ Expandable Screen Completion Systems by Halliburton Energy Services Inc., or ESS® Expandable Sand Screens by Weatherford International, Inc. of Houston, Tex. See Brochure: "PoroFlex™ Expandable Screen Completion Systems," by Halliburton Energy Services Inc. and "ESS technology improves productivity, cuts cost," *Drilling Contractor* (March/April 2001) 44–46, which are incorporated herein by reference.

In FIG. 15 the bypass tubes 56 are blank and exit ports 51 are located at the connectors 50 for the shroud 20. In FIG. 16 the bypass tubes 56 have exit ports 58 along their length. FIG. 17 shows a combination of the configurations shown in FIGS. 15 and 16.

The creation of one or more fractures in the unconsolidated subterranean zone to be completed in order to stimulate the production of hydrocarbons therefrom is well known to those skilled in the art. The hydraulic fracturing process generally involves pumping a viscous liquid containing suspended particulate material into the formation or zone at a rate and pressure whereby fractures are created therein. The continued pumping of the fracturing fluid extends the fractures in the zone and carries the particulate material into the fractures. The fractures are prevented from closing by the presence of the particulate material therein.

The subterranean zone to be completed can be fractured prior to or during the injection of the particulate material into the zone, i.e., the pumping of the carrier liquid containing the particulate material through the perforated shroud into the zone. Upon the creation of one or more fractures, the particulate material can be pumped into the fractures as well as into the perforations in the casing (for cased wells) and into the annuli between the sand screen and perforated shroud and between the perforated shroud and the wellbore.

To further illustrate an aspect of the present invention, and not by way of limitation, the following example is provided.

Flow tests were performed to verify the uniform packing of particulate material in the annulus between a simulated wellbore and sand screen. The tests were performed using a fixture, which included an acrylic casing for simulating a wellbore. The acrylic casing had a 8½ in.-ID and a total length of 40 ft. A POROPLUS™ sand screen was installed inside the casing. The sand screen had an OD of 5.15 in. and a length of 38 ft. A wash pipe with an OD of 3½ in. was inserted inside the screen. A perforated shroud was not used.

A high leak-off zone in the casing was simulated by a 2-foot massive leak-off flow cell. The leak-off zone was located about 12 ft. from the inlet. Water (no gel) was used as the carrier fluid and a gravel slurry of 20/40 mesh sand having a concentration of 1 lbm./gal. was pumped into the fixture at a pump rate of about 3.5 barrels/min. Leakoff in the 2-ft. massive leakoff section was 50%.

Two flow tests were performed to determine the packing performance of the fixture. Baseline testing was first established to determine what the normal gravel packing procedure would accomplish with excessive leakoff. Comparisons were then available for use in analyzing the added packing efficiency provided by the blank tube, multiple path system. Characteristics of the comparison test were the same as in the baseline case except for the addition of 1-inch OD PVC blank tube segments, 6 ft. in length, which were installed in the upper side of the wellbore, across the 2-ft. massive leakoff section. Five axially spaced-apart series of conduits were used, with the number of tubes in each series comprising 3 tubes, 3 tubes, 3 tubes (across the leakoff section), 2 tubes and 2 tubes, respectively (beginning at about the 6 foot location). The blank tubes in each series were equidistantly-spaced in the circumferential direction of the sand screen (with the upper and lower ends of the tubes in each series terminating at the same level in the axial direction). The tubes in the adjacent 3-tube series, and the tubes in the adjacent 2-tube series, respectively, were axially aligned, with the end portions of each axially adjacent pair of tubes being spaced about 1 inch apart. The runs were made in a horizontal position.

In both tests, sand quickly packed around the screen and packed off the massive leak-off area whereby sand bridges were formed. However, in the comparison test the sand slurry flowed through the conduits, bypassed the bridged areas and completely filled the voids resulting in a complete sand pack throughout the annulus between the sand screen and the casing. In the baseline test, the beta wave started at between the 16 and 17 ft. location. In the comparison test, the beta wave started at the 33 to 34 ft. location. Further, it was observed in the comparison test, that eddy currents were created between the (facing) ends of axially adjacent pairs of (axially-aligned) blank tubes enhancing the effectiveness of the present invention.

The improved well tool can be applied in both an eccentric position within the wellbore or in a concentric position (e.g., by means of centralizers).

Thus, the present invention is well adapted to carry out the objects and attain the ends and advantages mentioned as well as those which are inherent therein. Of course, the invention does not require that all the advantageous features and all the advantages need to be incorporated into every embodiment of the invention. While numerous changes may be made by those skilled in the art, such changes are included in the spirit of this invention as defined by the appended claims. The invention is not limited to the specific structures and variations disclosed but will permit obvious variations within the scope of the invention as defined by the claims herein.

What is claimed is:

1. An improved method of completing a subterranean zone penetrated by a wellbore comprising the steps of:

(a) placing in said wellbore in said zone a perforated liner comprising a plurality of joints and having an internal sand screen disposed therein whereby an annulus is formed between said perforated liner and said wellbore;

(b) positioning at least one pair of upper and lower axially-spaced pluralities of conduits in juxtaposition with said perforated liner on one of said joints, at least one of said pluralities of conduits having an inlet portion for receiving a slurry of particulate material, and at least one of said pluralities of conduits having an opening for communicating the conduits with said annulus;

(c) locating between said at least one pair of upper and lower pluralities of conduits on said joint axially inset from the ends of the joint, a connector to fluidly communicate at least two of the upper plurality of conduits with at least two of the lower plurality of conduits;

(d) injecting the slurry of particulate material into said annulus and said at least one plurality of conduits adapted to receive slurry flow, whereby the fluid portion of the slurry is forced out of said annulus into said zone and the particulate portion of the slurry is deposited in said annulus.

2. The method of claim 1 wherein said particulate material is sand proppant.

3. The method of claim 1 wherein said particulate material is manmade proppant.

4. The method of claim 1 wherein said wellbore in said subterranean zone is open-hole.

5. The method of claim 1 wherein said wellbore in said subterranean zone has casing cemented therein with perforations formed through the casing and cement.

6. The method of claim 1 wherein said wellbore in said zone is horizontal.

7. The method of claim 1 which further comprises the step of creating at least one fracture in said subterranean zone prior to or while carrying out the injecting step.

8. The method of claim 7 which further comprises the step of depositing particulate material in said fracture.

9. The method of claim 1 wherein said second annulus is formed between said sand screen and said perforated liner and further comprising the step of injecting the slurry of particulate material into said second annulus.

10. An improved method of completing a subterranean zone penetrated by a wellbore comprising the steps of:

(a) placing in said wellbore in said zone a perforated liner comprising a plurality of joints and having an internal sand screen disposed therein whereby an annulus is formed between said perforated liner and said wellbore;

(b) positioning at least two axially-spaced pluralities of conduits in juxtaposition with said perforated liner on one of said joints, at least one of said pluralities of conduits having an inlet portion for receiving a slurry of particulate material, and at least one of said pluralities of conduits having an opening for communicating the conduits with said annulus;

(c) locating between an adjacent pair of said at least two pluralities of conduits on said joint axially inset from the ends of the joint, a connector to fluidly communicate the two adjacent pluralities of conduits;

(d) connecting a cross-over sub to the upper end of said perforated liner, said cross-over sub having an outlet port therein, and fluidly connecting said outlet port to said at least one plurality of conduits adapted to receive slurry flow, whereby fluid flowing through said outlet port will flow directly into the plurality of conduits; and (d) injecting the slurry of particulate material into said at least one plurality of conduits adapted to receive slurry flow, whereby the fluid portion of the slurry is forced out of said annulus into said zone and the particulate portion of the slurry is deposited in said annulus.

11. An apparatus for completing a subterranean zone penetrated by a wellbore comprising:

at least one joint, said joint comprising:

a perforated liner having an internal sand screen disposed therein, said perforated liner being dimensioned so that when it is disposed within said wellbore an annulus is formed between the perforated liner and the wellbore;

axially-spaced first and second pluralities of conduits along said perforated liner, said first plurality of conduits being adapted to receive a slurry of particulate material and said second plurality of conduits being adapted to deliver the slurry into at least a portion of the wellbore;

a manifold on said joint between the first and second pluralities of conduits adapted to fluidly communicate said pluralities of conduits and allow for mixing of slurry flowing into said manifold from the individual conduits comprising said first plurality of conduits prior to flowing from the manifold into said second plurality of conduits; and a crossover adapted to be attached to a workstring attached to said perforated liner and sand screen.

12. The apparatus of claim 11 wherein at least one of said pluralities of conduits is located inside said perforated liner.

13. The apparatus of claim 11 wherein at least one of said pluralities of conduits is located outside said perforated liner.

14. The apparatus of claim 11 wherein said crossover has an outlet port therein, and including means for fluidly connecting said outlet port to said first plurality of conduits whereby fluid flowing through said outlet port will flow directly into the first plurality of conduits.

15. The apparatus of claim 11 wherein a second annulus is formed between said sand screen and said perforated liner.

16. The apparatus of claim 11 wherein said sand screen is an expandable-type screen.

17. The apparatus of claim 11 wherein the individual conduits comprising at least one of said pluralities of conduits, are radially spaced at predetermined intervals, generally parallel to each other and substantially the same length.

18. A method for gravel packing a well that penetrates a subterranean oil or gas reservoir, comprising:

(a) providing a wellbore through said reservoir;

(b) locating inside said wellbore a well screen comprising at least one joint, said joint comprising:

a perforated liner having an internal sand screen disposed therein, an annulus being formed between said perforated liner and said wellbore; and a plurality of conduit means positioned in juxtaposition with said perforated liner, at predetermined intervals in the axial direction of the perforated liner, each of said conduit means being adapted to receive a fluid slurry containing gravel and allow said gravel-containing slurry to flow into said annulus, and at least two adjacent ones of said conduit means being fluidly communicated by a connecting means axially inset from the ends of said joint; and (c) injecting the slurry containing gravel into said annulus and at least one of said conduit means whereby the fluid portion of the slurry is forced out of said annulus and the gravel portion of the slurry is deposited in said annulus.

19. The method of claim 18 wherein at least one of said conduit means includes an axially-extending bypass conduit having its upper extremity open to fluids.

20. The method of claim 18 wherein at least one of said conduit means includes an axially-extending bypass conduit having an opening to establish fluid communication between said bypass conduit and said annulus.

21. The method of claim 18 wherein at least one of said connecting means is sealed to fluid from said perforated liner.

22. The method of claim 18 wherein at least one of said connecting means has an opening to establish fluid communication between the connecting means and said annulus.

23. A method for gravel packing a well that penetrates a subterranean oil or gas reservoir, comprising:

(a) providing a wellbore in said reservoir;

(b) placing in said wellbore a perforated liner comprising a plurality of joints and having an internal sand screen disposed therein, an annulus being formed between said perforated liner and said wellbore;

(c) positioning at least one upper and one lower conduit in juxtaposition with said perforated liner on at least one of said joints, at least one of said conduits being adapted to receive a slurry of particulate material from a workstring, and at least one of said conduits being adapted to permit the slurry to flow into said annulus;

(d) fluidly connecting an adjacent pair of said at least one upper and one lower conduits on said at least one joint with a connector, prior to or while coupling said one joint to another joint; and (e) injecting said fluid slurry containing gravel into said at least one conduit adapted to receive slurry flow whereby the fluid portion of the slurry is forced out of said annulus into said reservoir and the gravel portion of the slurry is deposited in the annulus.

24. An alternate-path well screen comprising:

at least one screen joint, said screen joint comprising:

a perforated shroud having an internal sand screen disposed therein;

upper and lower pluralities of alternate flowpaths extending along said perforated shroud, each of said flowpaths comprising an axially-extending conduit having an inlet portion and an outlet portion; and a manifold means on said joint between said upper and lower pluralities of alternate flowpaths and axially inset from the ends of the joint, for fluidly connecting the pluralities of alternate flowpaths, wherein said manifold means comprises:

a body located on said perforated shroud, said body having openings for communicating with said conduits and defining at least a portion of an annular space wherein flow from all of said conduits comprising the upper plurality of alternate flowpaths flows into said annular space and then from said annular space into the conduits comprising said lower plurality of alternate flowpaths.

25. The alternate-path well screen of claim 24 wherein at least one of said conduits has an opening along its length adapted to fluidly communicate the conduit with a wellbore when said well screen is in an operable position within said wellbore.

26. The alternate-path well screen of claim 24 wherein said manifold means has an opening adapted to establish fluid communication between the manifold means and a wellbore when said well screen is in an operable position within said wellbore.

27. A well screen comprising:

at least one joint, said joint comprising:

a base pipe having a screen thereon;

a coupling on one end of said base pipe adapted to connect said base pipe to another joint;

a shroud surrounding said screen, said shroud having a plurality of openings in the wall thereof;

axially-spaced first and second pluralities of conduits along and abutting said shroud, said conduits having an inlet portion and an outlet portion; and a connector on said base pipe for fluidly communicating said first and second plurality of conduits together and adapted to be connected prior to or while the base pipe is connected to said other joint.

28. The well screen of claim 27 wherein said connector comprises two segments adapted to be joined together.

29. The well screen of claim 28 wherein the two segments of the connector are adapted to be threaded together.

30. A sand screen structure for a well, comprising:

a plurality of generally tubular axial filter sections coaxially disposed in an end-to-end orientation, wherein each of said filter sections includes:

a perforated tubular inner body member having opposite end portions;

a porous tubular outer body member outwardly circumscribing said inner body member and having opposite end portions;

a first and second series of axially-extending conduits disposed on the outer periphery of said outer body member at a predetermined interval in the axial direction; and cooperating means between said first and second series of conduits and axially inset from said opposite end portions of said inner body member for fluidly mixing flow from the first series of conduits.

31. The sand screen structure of claim 30 wherein the inner periphery of said cooperating means and the outer periphery of said outer body member define a portion of an annulus that functions as a space for communicating the flowpaths of the first and second series of conduits together.

32. A well tool comprising:

at least one joint, said joint comprising:

a base pipe having a screen section thereon;

a slotted liner surrounding said base pipe;

axially-spaced upper and lower pluralities of conduits provided on the periphery of said slotted liner;

a connector for fluidly connecting said upper and lower pluralities of conduits; said connector comprising:

a body on said slotted liner between said upper and lower pluralities of conduits; and a passage axially extending through said body, said passage adapted to receive said first plurality of conduits into a first end of said passage and said second plurality of conduits into the other end of said passage to thereby fluidly connect said pluralities of conduits when said connector is in a connected position.

33. The well tool of claim 32 wherein said joint is adapted to be coupled to another joint having basically the same construction, and said connector is adapted to be positioned in a connected position prior to or while said two joints are coupled together.

34. The well tool of claim 32 wherein said body is formed of two portions which are threaded together.

35. The well tool of claim 32 wherein the interior of said connector is isolated from fluid communication with the interior of said slotted liner.

36. The well tool of claim 32 wherein an annulus portion is defined by the inner side of said connector and the outer periphery of said slotted liner.

37. The well tool of claim 32 wherein the space between the outer periphery of said slotted liner and the inner periphery of said connector functions as a space for fluidly connecting said first and second pluralities of conduits.

38. A well screen having a slurry flow path comprising:

at least one joint, said joint comprising:

a permeable section comprising a base pipe having a plurality of openings therein and screen material positioned around said base pipe;

a shroud surrounding said permeable section, said shroud having a plurality of openings in the wall thereof;

a plurality of series of bypass tubes provided at predetermined intervals in the axial direction of and abutting the shroud; and cooperating means for fluidly connecting two adjacent ones of said plurality of bypass tube series, said cooperating means comprising a connector between the two adjacent bypass tube series, at least a portion of an annulus being defined by said connector which functions as a space for communicating the two bypass tube series with each other.

39. The well screen of claim 38 wherein each of said bypass tube series comprises one or more tubular flow paths for gravel-containing slurry provided on the outer periphery of said shroud and extending in the axial direction of the shroud, said flow paths being isolated from direct fluid communication with the interior of said shroud, and having openings adapted to communicate the flow paths with a wellbore when said well screen is in an operable position within said wellbore.

40. The well screen of claim 38 wherein said connector includes a tubular outer body member outwardly circumscribing a tubular inner body member, and opposite cover plate portions, and the space for communicating the two adjacent bypass tube series is defined by the annulus between the inner and outer body members and the inner periphery of said cover plate portions.

41. The well screen of claim 38 wherein said connector includes a tubular outer body member outwardly circumscribing said shroud, and opposite cover plate portions, and said annulus for communicating the two adjacent bypass tube series is defined by the periphery of said outer body member, the outer periphery of said shroud and the inner periphery of said cover plate portions.

* * * * *